US006364571B1

(12) United States Patent
Doolaege

(10) Patent No.: US 6,364,571 B1
(45) Date of Patent: Apr. 2, 2002

(54) FLEXIBLE HYDRAULIC STRUCTURE WITH RIGHT ANGLE TUBE FITTED THERETHROUGH

(76) Inventor: David Doolaege, P.O. Box 206, Carlotta, CA (US) 95528

( * ) Notice: Subject to any disclaimer, the term of this patent is extended or adjusted under 35 U.S.C. 154(b) by 0 days.

(21) Appl. No.: 09/669,911

(22) Filed: Sep. 26, 2000

Related U.S. Application Data

(60) Continuation of application No. 09/385,821, filed on Aug. 30, 1999, now abandoned, which is a division of application No. 08/939,471, filed on Sep. 22, 1997, now abandoned.

(51) Int. Cl.[7] ..... E02B 7/02

(52) U.S. Cl. ..... 405/115; 405/16; 405/21; 405/91; 405/114

(58) Field of Search ..... 405/15, 16, 21, 405/43, 52, 114, 115, 63–68, 91; 114/266, 267; 138/97, 98

(56) References Cited

U.S. PATENT DOCUMENTS

| | | | | | |
|---|---|---|---|---|---|
| 1,905,919 | A | * | 4/1933 | Levis | 405/125 X |
| 3,369,664 | A | * | 2/1968 | Dahan | 405/68 |
| 3,861,158 | A | * | 1/1975 | Swain et al. | 405/172 |
| 4,352,591 | A | | 10/1982 | Thompson | |
| 4,752,393 | A | * | 6/1988 | Meyers | 405/72 X |
| 4,836,713 | A | * | 6/1989 | Muramatsu et al. | 405/115 |
| 4,919,567 | A | * | 4/1990 | Sample | 405/19 |
| 4,966,491 | A | | 10/1990 | Sample | |
| 4,998,847 | A | * | 3/1991 | Thurber | 405/127 |
| 5,040,919 | A | | 8/1991 | Hendrix | |
| 5,059,065 | A | * | 10/1991 | Dooleage | 405/115 |
| 5,140,848 | A | * | 8/1992 | Spencer | 73/46 |
| 5,645,373 | A | | 7/1997 | Jenkins | |
| 5,785,455 | A | | 7/1998 | Eaker | |
| 5,857,806 | A | * | 1/1999 | Melin | 405/115 |
| 5,865,564 | A | | 2/1999 | Miller et al. | |
| 5,980,837 | A | * | 4/1999 | Wells | 405/43 |
| 6,126,362 | A | * | 10/2000 | Carter et al. | 405/114 |

FOREIGN PATENT DOCUMENTS

| | | | | |
|---|---|---|---|---|
| DE | 3934530 A1 | * | 4/1991 | 405/115 |

* cited by examiner

*Primary Examiner*—David Bagnell
*Assistant Examiner*—Jong-Suk Lee
(74) *Attorney, Agent, or Firm*—M. Reid Russell

(57) ABSTRACT

A water structure formed from a pair of flexible tubes or sleeves that each receive a volume of water and are maintained within a containment sleeve, and including a vertical tube fitted through the containing sleeve to pass between and is separated from the water filled flexible tubes or sleeves.

3 Claims, 8 Drawing Sheets

FLEXIBLE HYDRAULIC STRUCTURE WITH RIGHT ANGLE TUBE FITTED THERETHROUGH

CROSS REFERENCES TO RELATED APPLICATION

The present application is a continuation application from a Ser. No. 09/385,821 filed Aug. 30, 1999, for a U.S. Patent entitled "A FLEXIBLE HYDRAULIC STRUCTURE WITH RIGHT ANGLE TUBE FITTED THERETHROUGH" that was based upon an original application filed on Sep. 22, 1997, abandoned Ser. No. 08/939,471, for "METHOD AND APPARATUS FOR CONSTRUCTING HYDRAULIC STRUCTURES".

BACKGROUND OF THE INVENTION

1. Field of the Invention

This invention relates to structures for damming water courses, controlling water flow, working and support structures, and the like, and, in particular, is to provide a low cost and easily constructed tubular sleeve or envelope arrangement with divider or baffle walls, and/or multiple sleeves or envelopes with arrangements for maintaining the filled sleeves or envelopes together to form a variety of structures.

2. Prior Art

A need for easily installable dam structures, and the like, particularly structures that are relatively inexpensive, non-permanent, reusable and are durable has been early recognized by the inventor who has been awarded U.S. Pat. No. 's 5,059,065 and 5,125,767 for joining water structures together to form hydraulic damming structures, and the like. Such structures have been found to be very useful for safely and reliably containing or controlling water and are also particularly useful for controlling oil or chemical spills, for flood control, and the like. Such control structures are also useful, for example, for temporary damming operations such as may be involved in agricultural, construction, or like operations for de-watering work sites, fields, or the like, for use as temporary breakwaters, coffer dams, and the like.

Heretofore it has been recognized that fluid filled flexible control structures and barriers can be used for retention of water, control of water flow and wave action, and a number of configurations of dams and barriers formed as temporary structures have been developed. Additional to the U.S. patents of the inventor, some other such arrangements are shown, for example, in U.S. Patents to: Mesnager, U.S. Pat. No. 2,609,666; Mesnheger, U.S. Pat. No. 3,246,474; Imbertson, et al, U.S. Pat. No. 3,355,851; Renfro, U.S. Pat. No. 3,465,530; Tabor, U.S. Pat. No. 3,834,167; Hornbostel, Jr., U.S. Pat. No. 3,373,568; Hepworth, et al, U.S. Pat. No. 3,957,098, Suga, et al, U.S. Pat. No. 4,279,540; Muramatsu, et al, U.S. Pat. No. 4,299,514; Tsuiji, et al, U.S. Pat. No. 4,314,774; Clem, U.S. Pat. No. 4,501,788; Paoluccio, U.S. Pat. No. 4,555,201; Holmberg, U.S. Pat. No. 4,690,585; Stevens, U.S. Pat. No. 4,784,520; and Brodersen, U.S. Pat. No. 4,799,821. The above show various containment, dam and barrier configurations ranging from permanent to portable structures, and include, as shown in Stevens and Brodersen, structures for encircling a chemical or oil spill. Additionally, a Swiss patent No. CH657,884 to Fure shows a dam type containment structure. Further, a breakwater arrangement is shown in a U.S. patent to Sample, No. 4,729,691, that includes a plurality of sand filled bags that are contained within an outer sleeve to serve as a barrier in an erosion control system. The above cited patents generally involve inflatable envelope arrangements that include some anchor structures therewith, and are generally restricted in that they don't rely on water to form the structure and include anchors that must be permanently installed. Further, most such earlier arrangements require extensive site preparation and a number actually include a concrete bottom and sidewalls to provide for structure stability and barrier support thereby precluding their use as temporary water structures as provided by the present invention.

Summarizing, none of the above set out arrangements, provide, a simple barrier arrangement or arrangements of barriers that include filled or partially filled sleeves or envelopes with arrangements for anchoring the sleeves or envelopes, and which filled sleeves or envelopes can themselves support other structural elements to perform a number of functions as do the embodiments of the present invention. Where the above set out earlier patents of the inventor teach water containing sleeves or envelopes formed into a structure for arrangement as a dam, or the like, and a connecting sleeve arrangement for use with such water structures, neither of these patents involve the various arrangements for maintaining the water filled sleeves or envelopes together or for anchoring them along their lengths, or for their uses with other structures as does the present invention.

BRIEF SUMMARY OF THE INVENTION

It is therefore a principal object of the present invention to provide a hydraulic structure that is formed from a section or sections of water filled sleeves, envelopes, or the like, that may be fitted together in end-to-end, or in intersecting relationship, for forming dams, breakwaters, piers, bridging structures, docks, platforms for drilling, and the like, where such formed structure will be stable even when subjected to a transverse hydraulic force or forces as would tend to move the structure.

Another object of the present invention is to provide a single or plurality of water filled sleeves, envelopes or the like, that are formed or connected to resist movement when a transverse or side hydraulic force, or the like is directed thereagainst.

Another object of the present invention is to provide, with a single sleeve as a water filled structure, a longitudinal center divider, longitudinal baffle, or spaces longitudinal baffles for discouraging or dampening a side load within the water filled sleeve as could be created by application of a transverse or side hydraulic load into the sleeve as could roll the sleeve.

Another object of the present invention is to provide a water filled structure formed from a pair of sleeves as water bodies, water columns, envelopes, or the like, that are filled with water and are to be connected together along longitudinal shared surfaces so as to preclude their separation when a transverse or side hydraulic load force is applied to either or both of the water filled structures.

Still another object of the present invention is to include, with a pair of water filled sleeves, envelopes, or the like, that are maintained together along longitudinal shared surfaces, or with a single sleeve that includes a center dividing wall, a further component, components, or devices therewith to allow, for example, the water filled structure to be used as a drilling platform, dock, bridge, or the like.

Still another object of the present invention is to provide a water filled structure that can include a floating arrangement such as a styrafoam core, separate air or lighter than water filled sleeves, tubes, containers, or the like fitted therein, to produce a buoyancy in the water filled structure so as to facilitate its being used as a floating platform, boom, dock, break water or the like.

Still another object of the present invention is to provide a sleeve, envelope, or the like that includes an arrangement for fitting a replacement sleeve or envelope into a damaged sleeve or envelope that contains water without a necessity to completely drain the damaged sleeve or envelope.

Still another object of the present invention is to provide a water filled structure formed from a single or number of sleeves, envelopes, or the like, with the single sleeve to include a dividing wall, baffle, or the like, and with the plurality of sleeves maintained together, and may include a separate buoyancy arrangement, with the structure arranged to be easily filled with water and includes drain and fill ports that are all conveniently and safely operated even in a desolate and/or unimproved area, which sleeves, envelopes, or the like, are easy to maintain, and can be installed with minimum to no site preparation.

The present invention is in at least one flexible sleeve or envelope arrangement or arrangements that can be closed at its ends to receive and retain a volume of water. Such single sleeve preferably includes a dividing wall or walls or other baffle arrangement to prohibit an applied transverse hydraulic force from rolling the water containing sleeve. The dividing wall can be formed to extend the length of the sleeve and is connected at longitudinal axis along the sleeve or envelope inner surface, dividing the sleeve into two or more compartments. Or individual wall sections can be secured along their opposite edges to the sleeve inner surface, with gaps or spaces left between the individual sections that then functions as baffles, or, alternatively a single longitudinal dividing wall having a plurality of holes or openings formed therethrough and can be secured to the sleeve inner surface, dividing the sleeve into two or more sections, to function as a baffle. Such single sleeve or envelope with dividing wall, walls or baffle arrangement can include inlet and exhaust valves, as needed, and can further include an air inlet or bleed valve arrangement, within the scope of this disclosure.

Additional to a single sleeve that is divided by a longitudinal wall, multiple walls, baffle, or baffles, the invention can include a pair or more of tubes sleeves or envelopes that are connected together as by an adhesive, hot weld, or the like, along shared surfaces to form a pair of connected containers that, when water filled, will resist rolling apart when a side or transverse or side hydraulic load or force is applied thereto. Such single sleeve pair of sleeves, or multiple sleeves can be connected end to end with like sleeve arrangements utilizing a coupling sleeve arrangement like that shown in my earlier U.S. Pat. No. 5,059,065, or the like. So arranged, a control structure is provided as for damming or dewatering operations, that can include inlet and vent valve arrangements for passing water or air into and draining water and air from the individual sleeves. Also, an additional sleeve or envelope, sleeves or envelopes, can be provided to contain the multiple sleeves for maintaining the pair of bodies water filled sleeves or envelopes together, and such arrangement or arrangements can include additional structure such as, a vertical tube for use in drilling operations, or a horizontal tube to function as a calvert, buoyancy tube or tubes, to be filled with a buoyant material such as to provide buoyancy in water to the structure.

Additionally, a sleeve having a number or compartments formed therein to individually receive a buoyance material to provide a desired buoyancy in water for use as a dock, platform, roadway bridge arrangement, or like type structure, can be so arranged within the scope of this disclosure.

A preferred sleeve arrangement is an open sleeve or envelope that can be closed at its ends and is formed from an appropriate flexible material. The sleeve, envelope or sleeves or envelopes may be reinforced internally, or externally may be contained in an additional sleeve, and may include a mat or web material secured thereto, or the like. Further, the invention may include an arrangement for fitting as by pulling, or the like, a second sleeve or envelope through a damaged first sleeve or envelope without a necessity for first fully draining the damaged sleeve or envelope. In practice a flexible polyethylene plastic tube manufactured by Layfield Plastics, having a range of wall thickness of from four (4) to ten (10) millimeters has been used successfully for the invention, though, it should be understood, the invention is not limited to any particular sleeve or tube manufacture or thickness, and can utilize sleeves of greater or lesser wall thickness, can include a further enclosing sleeve, and have a mat, of metal, fiber, glass or like secured thereto to provide reinforcement to the structure, within the scope of this disclosure.

DESCRIPTION OF THE DRAWINGS

In the drawings which illustrate that which is presently regarded as the best mode for carrying out the invention.

DETAILED DESCRIPTION OF THE INVENTION

Figure 1:
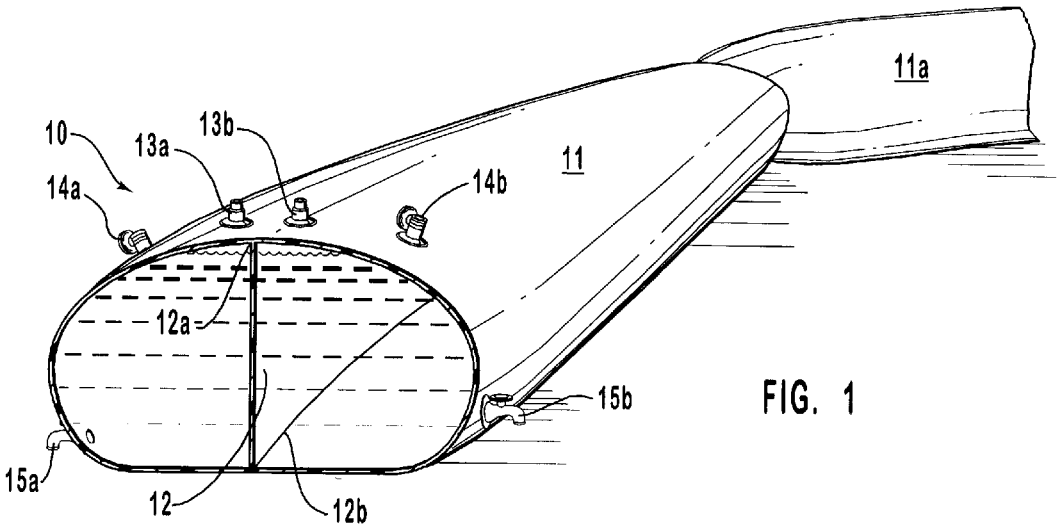
FIG. 1 is a frontal perspective view of a cross section of a single water filled tube, envelope, or sleeve forming a water structure of the invention, with the single tube or sleeve shown as including a divider that is longitudinally centered in the sleeve, separating it into two or more sections, and showing a second tube or sleeve connected end-to-end therewith through a connection arrangement.
Figure 5:
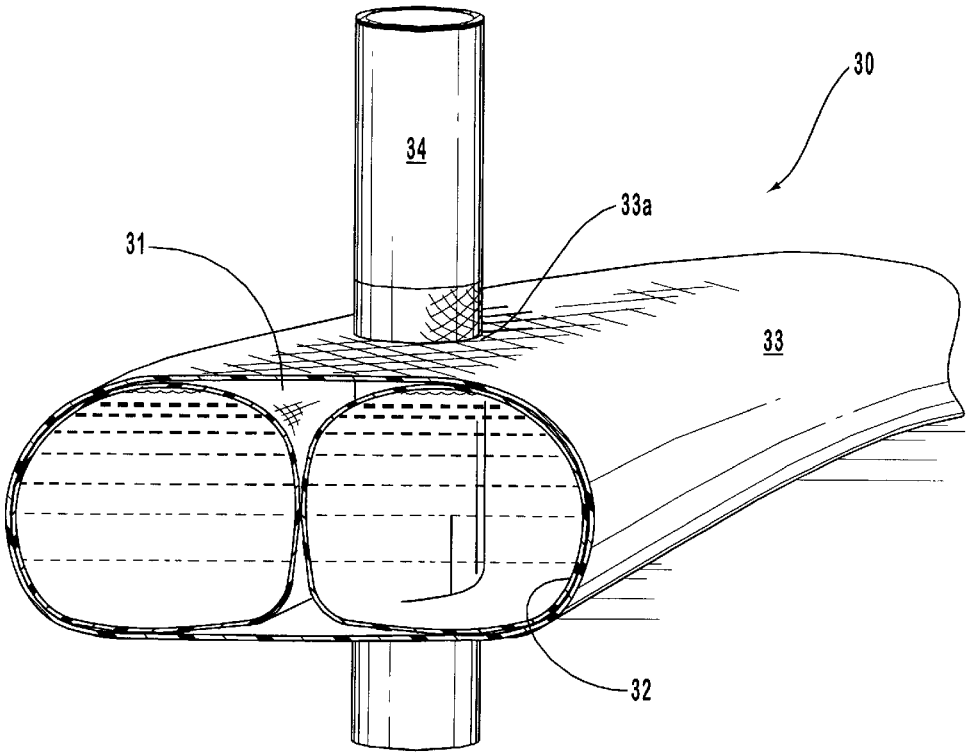
FIG. 5 is a frontal perspective view of a cross section of a pair of water filled tubes or sleeves shown contained in a third sleeve of the water structure and showing a vertical open cylinder passed through the third sleeve and fitted between the pair of tubes or sleeves.
Figure 5A:
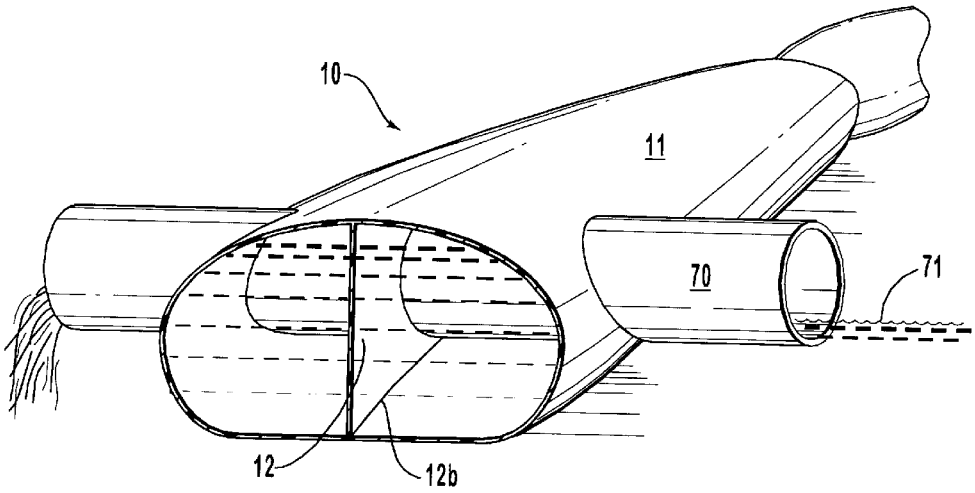
FIG. 5A is a view like FIG. 1 showing an open cylinder as having been passed through the water filled tube or sleeve and its center divider.
Figure 5B:
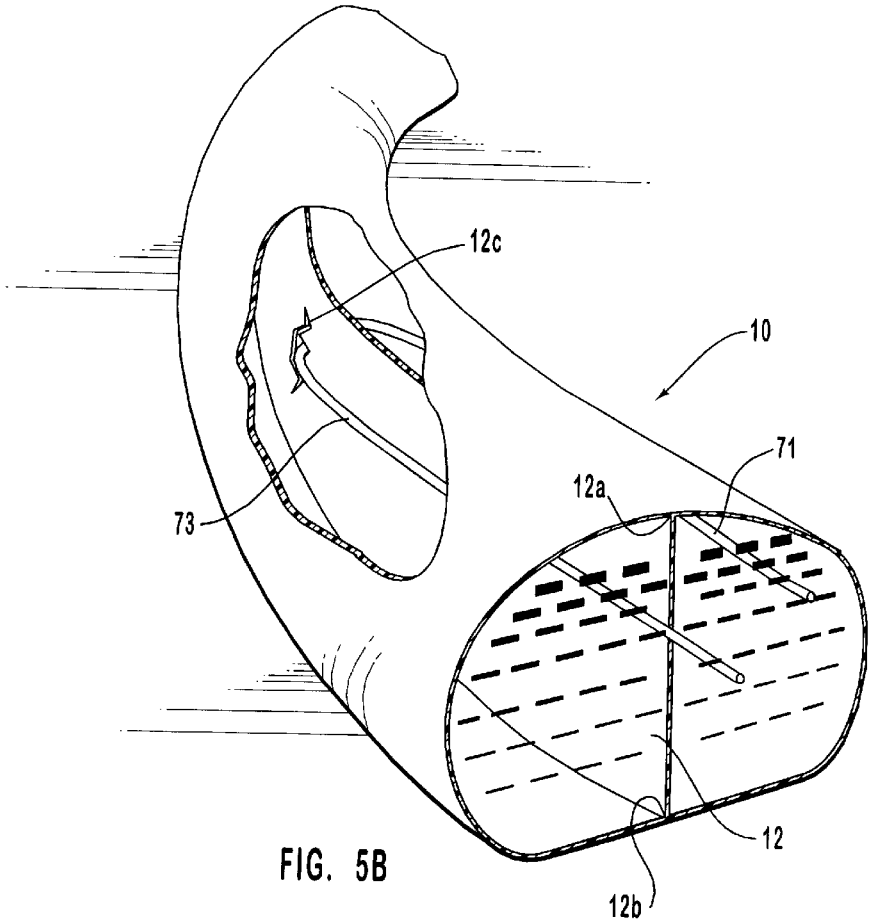
FIG. 5B is a view like that of FIG. 1 only showing a section of rope, cable, or the like passed through one section of the tube or sleeve, across the center dividing wall and out of the other section, which rope or cable is for attachment to an item to be pulled through the tube or sleeve.

FIGS. 1, 2, 3, 5B, 5C show a water structure 10 of the invention that is formed from a single water filled tube or sleeve 11, hereinafter referred to as sleeve, that can, as shown best in FIG. 1, be connected end-to-end to another such sleeve 11*a*, by a connection arrangement, not shown, to form a water barrier. Such end-to-end connection can, but need not within the scope of this disclosure, be accomplished utilizing a coupling sleeve arrangement like that of my earlier U.S. Pat. No. 5,059,065. The sleeve 11, as shown in FIGS. 1 and 5B, preferably includes a center longitudinal divider wall 12 secured along to extend between its parallel top and bottom edges 12*a* and 12*b*, across to the sleeve 11 inner surface, as by adhesive bonding, heat welding, or by a like procedure or arrangement as is suitable for joining the respective materials together. So arranged, the divider wall separates the sleeve 11 into two (2) independent water bodies compartments. The two (2) water body compartments are preferably individually vented, shown at vent ports 13*a* and 13*b*, as needed, that are located in the sleeve 11, adjacent to the divider wall 12 top edge 12*a*. Water is passed into the individual compartments through inlet valves 14*a* and 14*b*, and water as is to be drained from the individual compartments is passed through drains 15*a* and 15*b*, respectively. Alternatively, such water can be drained by opening an end of the sleeve 11.

Figure 2:
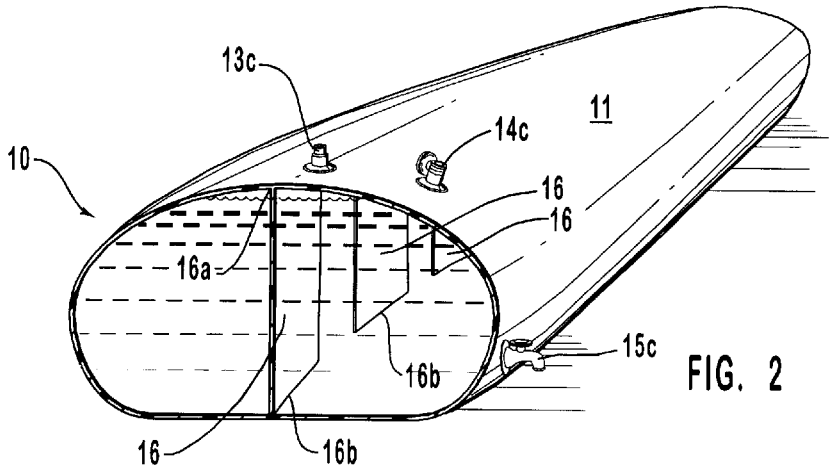
FIG. 2 is a view like that of FIG. 1 showing a single tube or sleeve of the water structure as including spaced sections that are secured across the tube interior wall as baffles.

FIG. 2 also shows a single sleeve 11 formed as a water structure 10 that, to resist rolling when subjected to a transverse or lateral hydraulic force directed into the sleeve 11 side, includes a plurality of wall segments 16 that are each secured, like the divider wall 12 of FIG. 1, at their opposite parallel edges 16*a* and 16*b*, to the sleeve inner surface, each divider wall extending across the sleeve interior. The segments 16, as shown in FIG. 2, are spaced apart from one another at intervals along the sleeve longitudinal center axis, forming individual baffles and are spaced to allow for a passage of water within the sleeve through the gaps or openings between which segments 16, So arranged, a transverse or lateral hydraulic force as is directed into the sleeve could create a transverse flow of water or wave across that sleeve that could tend to displace the sleeve, and cause it to roll, is inhibited and dampened by the segments 16. In operation, for filling and draining the sleeve 11 of FIG. 2, a single vent port 13*c*, inlet valve 14*c* and drain 15*c* only is shown, and, it should be understood one port only can be used for filling and draining and that the tube or sleeve can be opened at its end to drain water therefrom.

Figure 3:
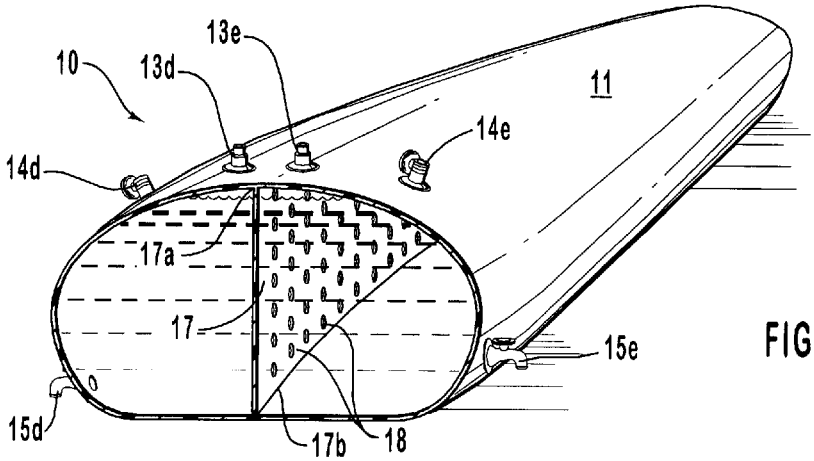
FIG. 3 is a view like those of FIGS. 1 and 2 showing a single water filled tube or sleeve of the water structure as including a center divider that is like that of FIG. 1 except that it includes a plurality of spaced holes formed therethrough to function as a baffle.

FIG. 3 shows still another arrangement of a single sleeve 11 as a water structure of the invention. Shown therein, the sleeve 11, like that of FIG. 1, includes a longitudinal divider wall 17 that is secured to the sleeve inner surface along opposite divider wall parallel edges 17*a* and 17*b*. The divider wall 17, like the divider wall 12 of FIG. 1, divides the sleeve 11 into two (2) sections or water bodies. The divider wall 17, of FIG. 3 is, however, to function as a water body separator or baffle and accordingly includes a number of spaced openings 18 formed therethrough functioning like the water structure described hereinabove with respect to FIG. 2. Accordingly, like the sleeve 11 of FIG. 2, as water is allowed to pass freely between the two (2) sections, through the divider wall 17 holes 18, single vent port 13*d*, inlet valve 14*d* and drain 15*d* only are shown.

Figure 4:
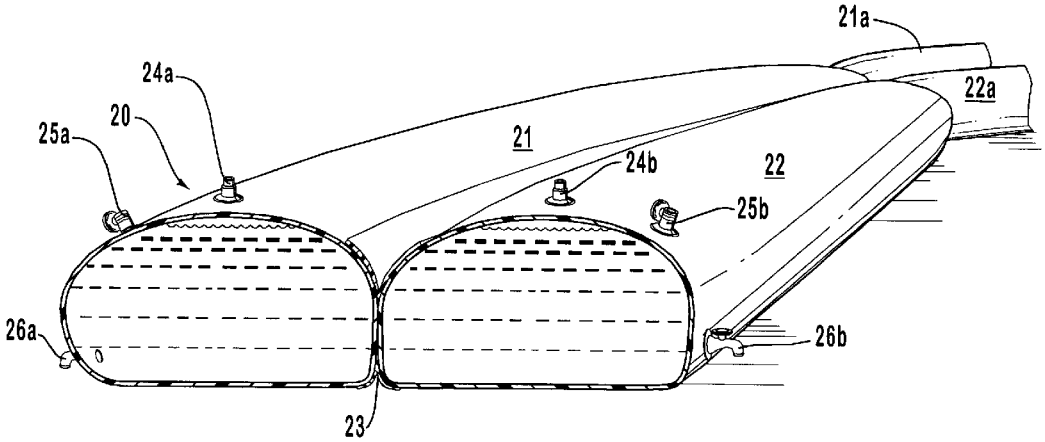
FIG. 4 is a frontal perspective view like that of FIG. 1 only showing 1 pairs of tubes or sleeves of the water structure joined longitudinally along their common surfaces, and showing a second pair of tubes or sleeves connected end-to-end therewith through a connection arrangement.

FIG. 4 shows a water structure embodiment 20 that is formed from at least two (2) separate sleeves 21 and 22, forming two columns or bodies of water, that are connected together along their common longitudinal surfaces 23 such that, when the sleeves are filled with water, the one sleeve or body of water will be stopped from rolling by the other sleeve or body of water when a side or transverse hydraulic load is directed onto the one sleeve or the other. Like the water structure 10 of FIG. 1, the water structure 20 sleeves 21 and 22 of FIG. 4 can be connected end-to-end to sleeves 21*a* and 22*a* for forming, for example, a continuous water barrier, such as a dam. Which end-to-end connected may but is not required to be like that described above with respect to FIG. 1. Further, like the two sections formed by the divider wall 12 of the water structure 10 of FIG. 1, as the two (2) sleeves 21 and 22 of FIG. 4 are each self contained, each sleeve 21 and 22 can include its own vent port 24*a* and 24*b*, respectively, its own inlet valve 25*a* and 25*b*, respectively, and pair of drains, with only a single drain 26*b* shown though, it should be understood, a drain can also be provided with sleeve 21. Which individual sleeves can each utilize one port only, or water can be drained from a sleeve by opening a sleeve end.

In practice, the water structures 10 and 20, as set out and described above, are useful, for example, as water barriers, such as dams, or to redirect water flow as flow channels, and the like, and accordingly the individual sleeves 11, 21 and 22 are preferably formed from a sleeve material having sufficient wall strength to preclude its rupture when subjected to anticipated hydraulic forces. Accordingly, a preferred material as has been used in practice for a manufacture of the sleeves 11, 21 and 22 is a flexible polyethylene plastic sleeve or tube that is manufactured by Layfield Plastics, having a range of wall thickness of four (4) to ten (10) millimeters, though, it should be understood, the invention is not limited to any particular manufacture of sleeve or tube or of a particular wall thickness, and other appropriate tubes or sleeves can be used within the scope of this disclosure. Further, as set out and discussed below with respect to FIGS. 9, 10, 10A, and 10B, a reinforcing material or structure, such as a web or mesh material, that is formed plate, deck, or the like, can be secured, as by bonding, or otherwise connected, to the sleeve outer or inner surface or sections thereof for lending strength or support thereto, as required, within the scope of this disclosure, and as discussed hereinbelow.

FIG. 5 shows still another embodiment of a water structure 30 that, like the water structure of FIG. 4, preferably includes a pair of water containing sleeves that are maintained together. Distinct therefrom, however, water structure 30 provides a third containing sleeve 33 for maintaining water filled sleeves 31 and 32 together. Which third containing sleeve 32 is to perform, essentially the same function as the bond 23 that is included between the shared surfaces of the sleeves 21 and 22 of FIG. 4. The arrangement of the water structure 30 of FIG. 5, it should be understood, is similar to that shown in may earlier U.S. Pat. No. 5,125,767, but, distinct therefrom, it further includes a work structure, support structure, connecting arrangement, or the like. One of which structures is shown in FIG. 5, as an open vertical tube 34 that has been fitted through top and bottom holes 33*a* formed in the containing sleeve 33, with the tube passed between the water filled sleeves 31 and 32 or may be passed through one of the sleeves 31 and 32.

FIG. 5A shows a further use of a separate transverse open cylinder 70 that has been fitted through and sealed in opposite sides and divider wall 42 of the single sleeve or tube 41 of FIG. 1. Which cylinder 70 is shown as conveying a flow of water 71 therethrough, functioning as a culvert.

FIG. 5B shows, for forming a water structure 10, a further use of the tube or sleeve 11 of FIG. 1 that includes the divider wall that is secured to the tube or sleeve inner surface, along opposite wall edges 12*a* and 12*b*, and includes a rope, cable, or the like, 73 fitted into one tube or sleeve section or body of water and is passed through an opening 12*c* formed through the divider wall 12, and travels back through the other sleeve or tube section or body of water. Which rope, cable, or the like, 73 can be used to pull a second sleeve or tube through the sections, as discussed hereinbelow with respect to FIG. 5C.

Figure 5C:
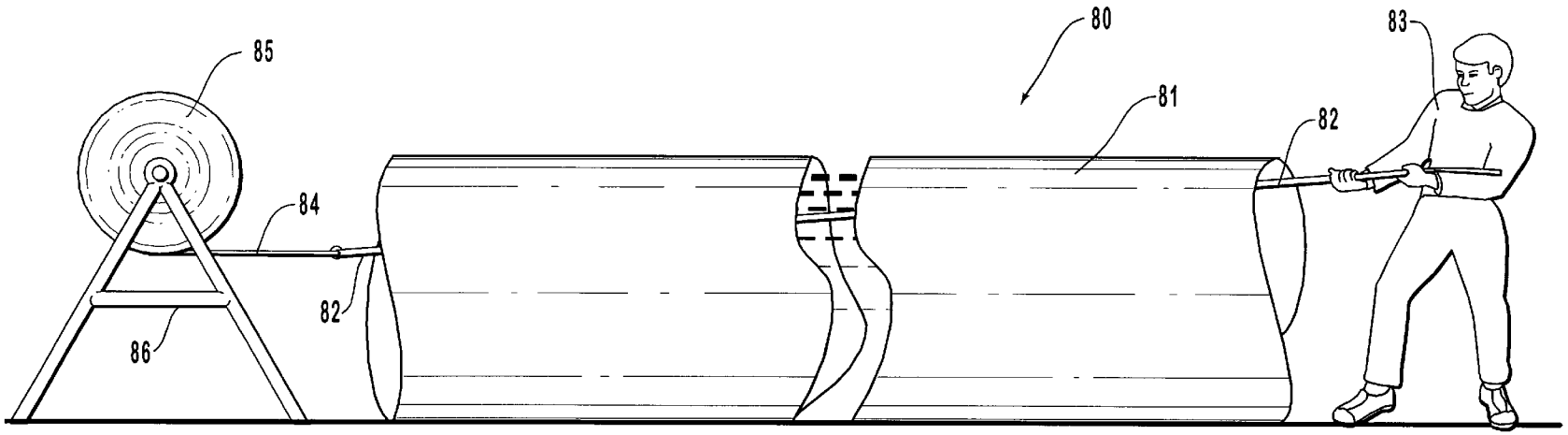
FIG. 5C is a side elevation view of a single first tube or sleeve shown as having had a rope, cable or the like fitted longitudinally therethrough and connected on one end to an end of a second tube or sleeve for use in pulling the second tube or sleeve through the first tube or sleeve.

FIG. 5C shows a tube or sleeve 81 of a water structure 80 that can be a single tube or sleeve, that has one or more dividing walls that are like that shown in FIG. 1, or can be another configuration, and includes a rope, cable, or the like 82, that is passed therethrough. The one end of which rope 82 is to be manipulated by an operator 83, with the other rope end connected to an end of a second tube or sleeve 84 that is shown as a roll 85 that is journaled to turn on a stand 86. In practice, the rope 82 is included in the first tube or sleeve 81 when it is filled in anticipation of problems developing with the first or primary tube or sleeve 81, such as a punctured, or the like, and where it is preferred to fit a second tube or sleeve 83 through the first, the rope 82 is positioned in the first tube 81 prior to filling. Thereafter, should the second tube 84 need to be fitted therethrough, even with the presence of significant water in the first tube 81, operators can open the first tube or sleeve ends and hold them above the water level in the first tube to prohibit water flow, and an operator 83 can then pull the second tube 84 therethrough. Which second tube can then be filled with water and the respective first and second tube ends closed. Water in the first tube can be allowed to leak from the first tube into the second or can be drained from the first tube while the second tube is filling. The first tube to thereafter function as a protective sheath or covering for protecting the second water filled sleeve 84.

Figure 6:
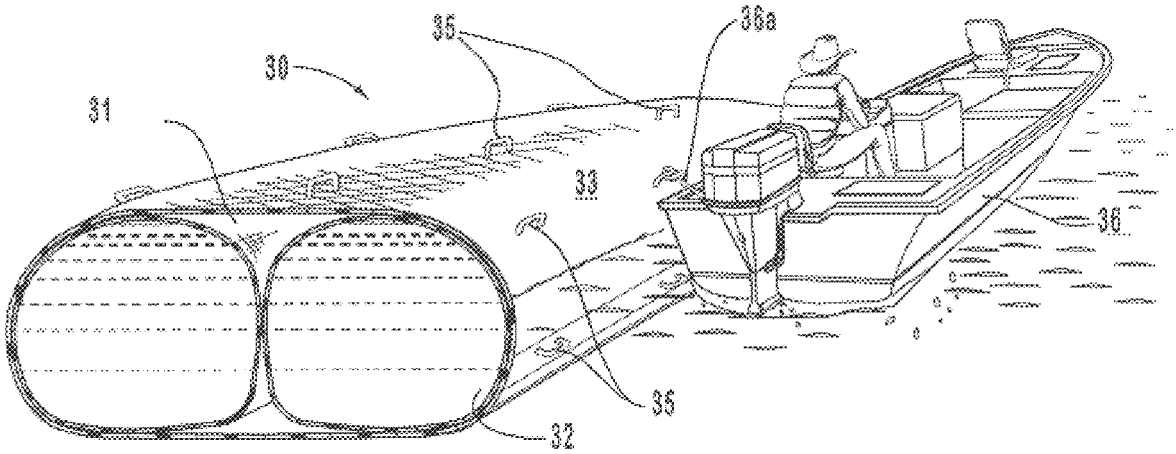
FIG. 6 is a frontal perspective view of a water structure that includes the pair of water filled tubes or sleeves contained in a third sleeve for use as a dock where the containing third sleeve is shown as including a number of mooring cleats that each extend outwardly and are at spaced intervals from the third sleeve surface for use in moaring a boat thereto.
Figure 7:
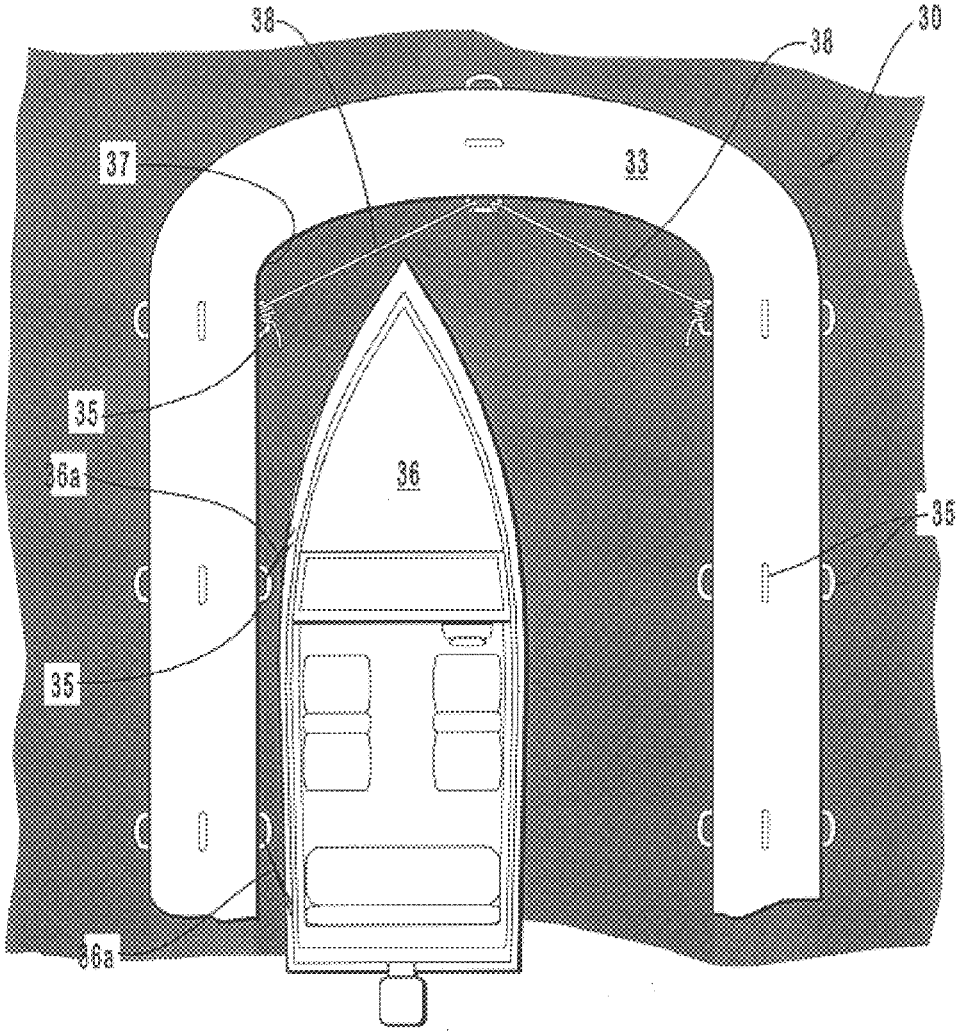
FIG. 7 is a top plan view of the dock of FIG. 6 shown as having been formed into a horse shoe shape with a boat shown moored within the area between the horseshoe sides.

Water structure 30, as shown in FIG. 6 includes a plurality of mooring cleats, shown herein as U shaped bars 35, loops, or the like, that are weaved or otherwise formed into material and are to extend out from the surface of the containing sleeve 33. The mooring cleats are for tying up a boat 36 as by a rope 36*a*. So arranged, the water structure 30 of FIG. 6 functions as a dock. Similarly, the water structure 30, as shown in FIG. 7, includes the containing sleeve 33 and mooring cleats 35, shown as the U shaped bars of FIG. 6, that extend therefrom, and showing the sleeve 33 bent into a horseshoe shape at bends 37. The horseshoe shape, as shown in FIG. 7, can be retained as by tying ropes 38 between mooring cleats 35, and FIG. 7 further shows a boat 36 moored by ropes 36*a* thereto that can accordingly be docked inside or outside the U shaped water structure 30.

Figure 8:
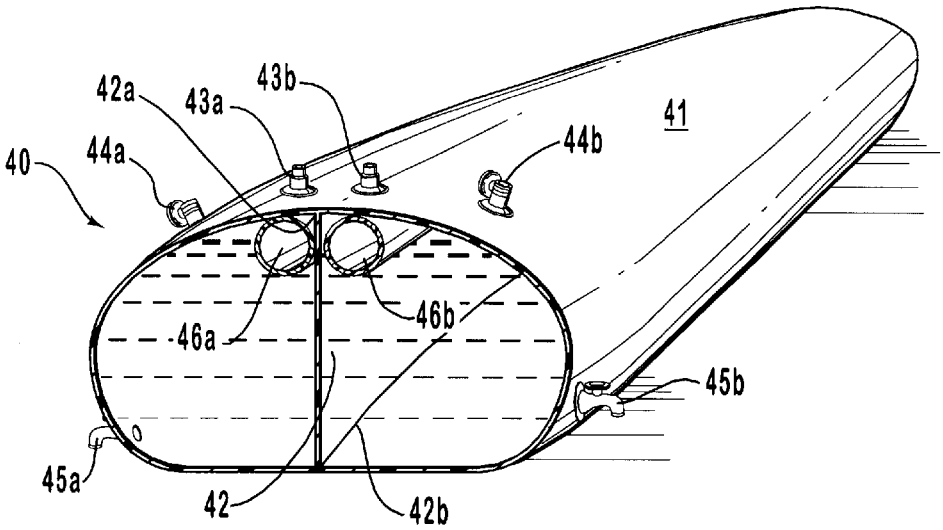
FIG. 8 is a view like that of FIG. 1 of the single water filled tube or sleeve water structure that includes a center dividing wall and further includes a pair of buoyance tubes fitted therein.

FIG. 8 shows still another embodiment of a water structure 40 that is like the water structure 10 of FIG. 1 in that it is arranged as a single sleeve 41 and includes a longitudinal center divider wall 42 secured along its parallel top and bottom edges 42*a* and 42*b* to extend across the sleeve inner surface. The divider wall 42 forms a pair of water body compartments or sections, that each may include vent ports 43*a* and 43*b*, with each compartment or section to be filled with water through inlet valves 44*a* and 44*b*, and or through the sleeve ends, and each compartment or section may include a drain 45*a* or 45*b*, respectively or may be drained through the sleeve ends. Distinct from the water structure 10 embodiment of FIG. 1, the water structure 40 further includes at least one buoyancy tube, compartment, or the like 46*a*, and preferably a pair of buoyancy tubes, compartments, sections or the like 46*a* and 46*b*, that are maintained within the single sleeve 41. The buoyancy tubes 46*a* and 46*b* are to be filled with a buoyant material to include Styrofoam, or the like, to allow the water structure 40 to float in water as a dock, or the like. For stability, the buoyancy tubes 46*a* and 46*b* are preferably located adjacent to the junctions of the divider wall top edge 42*a* with the single sleeve 41 inner surface, as shown.

Figure 9:
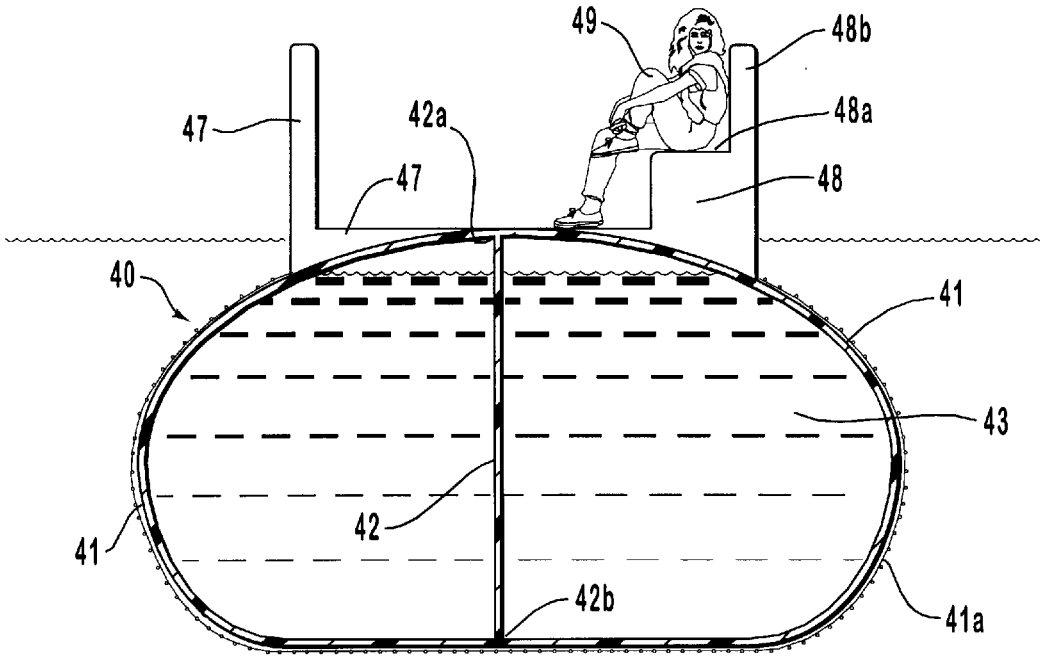
FIG. 9 is an end elevation view of the water structure of FIG. 1 showing the water structure as having an open top portion for filling with air, styrafoam, or the like, to provide buoyancy, and showing a deck structure maintained thereon.

FIG. 9 shows the water structure 40 less the buoyancy tubes 46*a* and 46*b*, and therefore is essentially the water structure 10 of FIG. 1. The water structure 40 of FIG. 9, however, like that of FIG. 8, is intended to be able to float and accordingly is preferably arranged to receive air, or other buoyancy material, passed therein shown as a volume of air above the layer 43 of water that is contained therein, or may be Styrofoam filled, or may be filled with another buoyant material, within the scope of this disclosure. A volume of air, or other buoyant material, can be introduced therein through the inlet valves 44*a* and 44*b* or the vent ports 43*a* and 43*b*, of FIG. 8, within the scope of this disclosure. Shown in FIG. 9, the water structure 40 is arranged for use as a dock or wharf to include a deck 47 that is accordingly maintained on a water structure top surface, above the layer of water 43 therein. As shown, the deck can include a fence 47*a* secured to extend upwardly from along one deck edge with a seat 48 having a horizontal portion 48*a* and a vertical portion 48*b* secured along the other deck edge. The seat, for illustration purposes, is shown as having a person 49 seated thereon, or another arrangement can be so provided for use as a permanent or semi-permanent structure. To add strength and durability to the water structure 40, an outer sleeve 41*a*, that is shown formed as a mat or ribbed surface is preferably secured over the sleeve 41 outer surface, adding strength thereto, providing a damage resistant surface.

Figure 10:
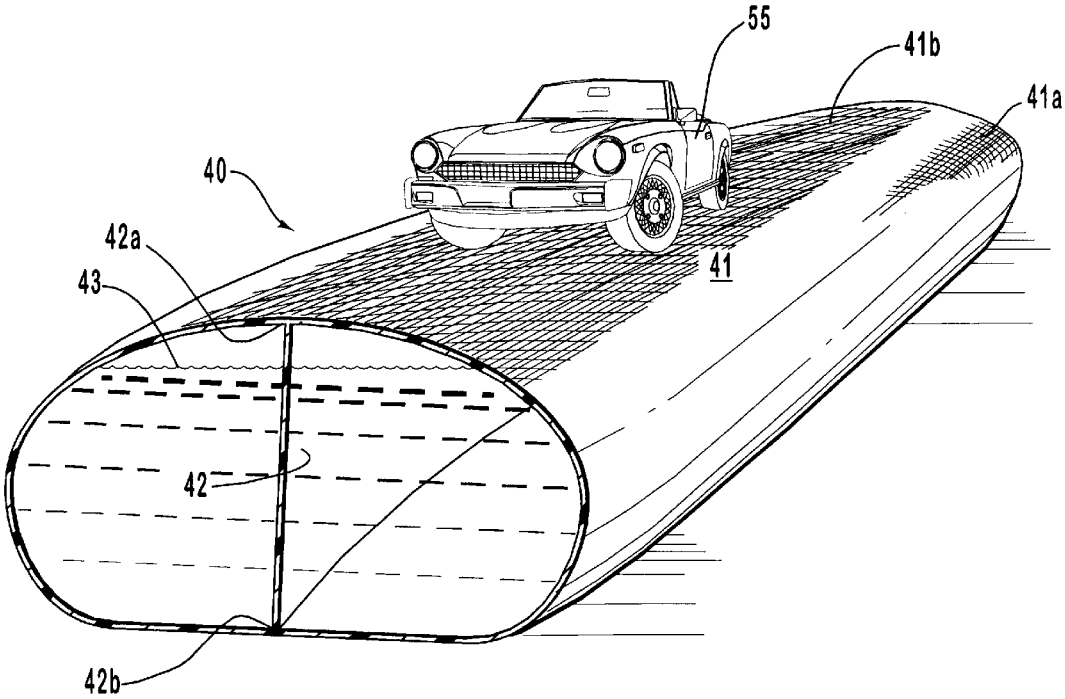
FIG. 10 is a view like that of FIG. 9 only showing a roadway type tread as having been formed in the top surface of the tube or sleeve and showing an automobile resting thereon.

FIG. 10 shows the water structure 40 of FIG. 9 less the deck 47 that has been replaced with a support surface 41*b* formed as by bonding it over the top surface of the single sleeve 41 whereon a vehicle 55 is shown resting. The water structure 40 of FIG. 10 can be arranged as a bridge, dock, or the like, to support vehicle travel thereover. Accordingly, it should be understood, the support surface 41*b* is preferably provided for reinforcing the structure and such may be formed from a mat, or the like, of a strong material that is bonded thereto to resist wear. Such reinforcing surface 41*b* may be a fabric or metal and its bond to the sleeve surface may be an epoxy, or like adhesive, within the scope of this disclosure.

Figure 10A:
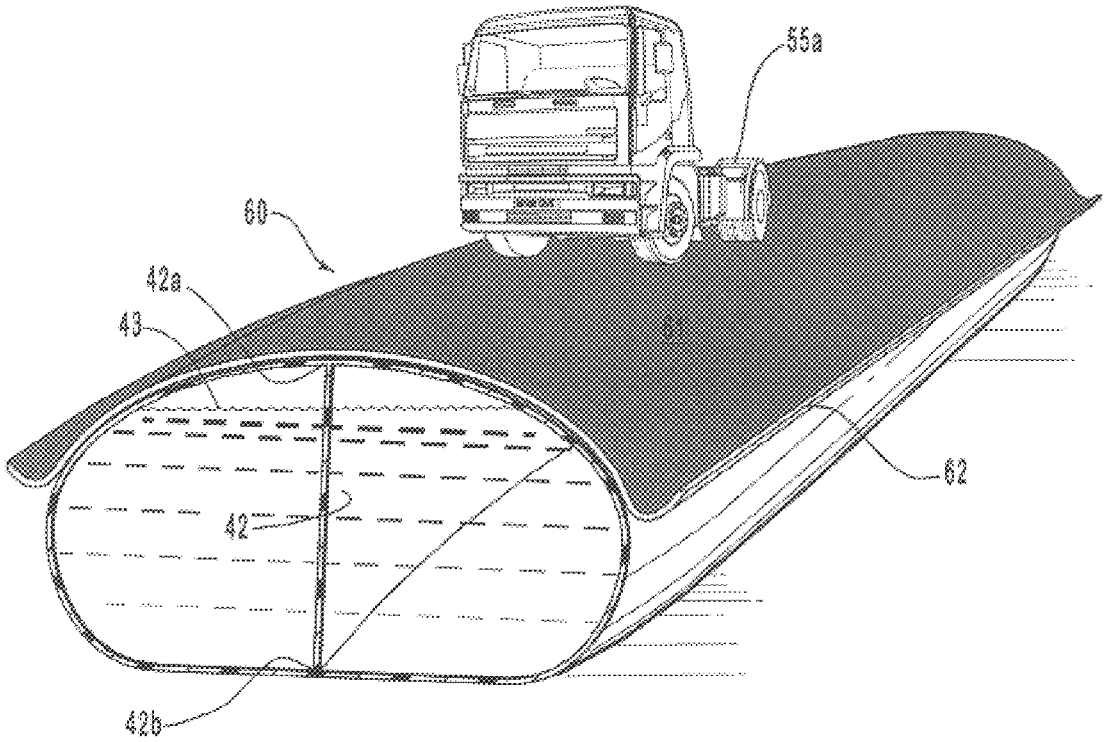
FIG. 10A is also a view like that of FIG. 9 only showing a separate rigid shell maintained ad a roadway over the tube or sleeve top surface supporting a truck thereon.

Like the water structure 40 of FIG. 10, a water structure 60 is shown in FIG. 10A that includes a cap 61 fitted along its top surface that is preferably a rigid strong material, such as metal or fiberglass, and is secured thereto. Like the water structure 40 of FIG. 10, the water structure 60 of FIG. 10A can provide a roadway for supporting a vehicle 55*a*, for example, traveling therealong. Additionally, as shown, the cap 61 preferably includes upturn edges 62 along the cap opposite longitudinal sides that are for use, as shown in FIG. 10B, for anchoring support members.

Figure 10B:
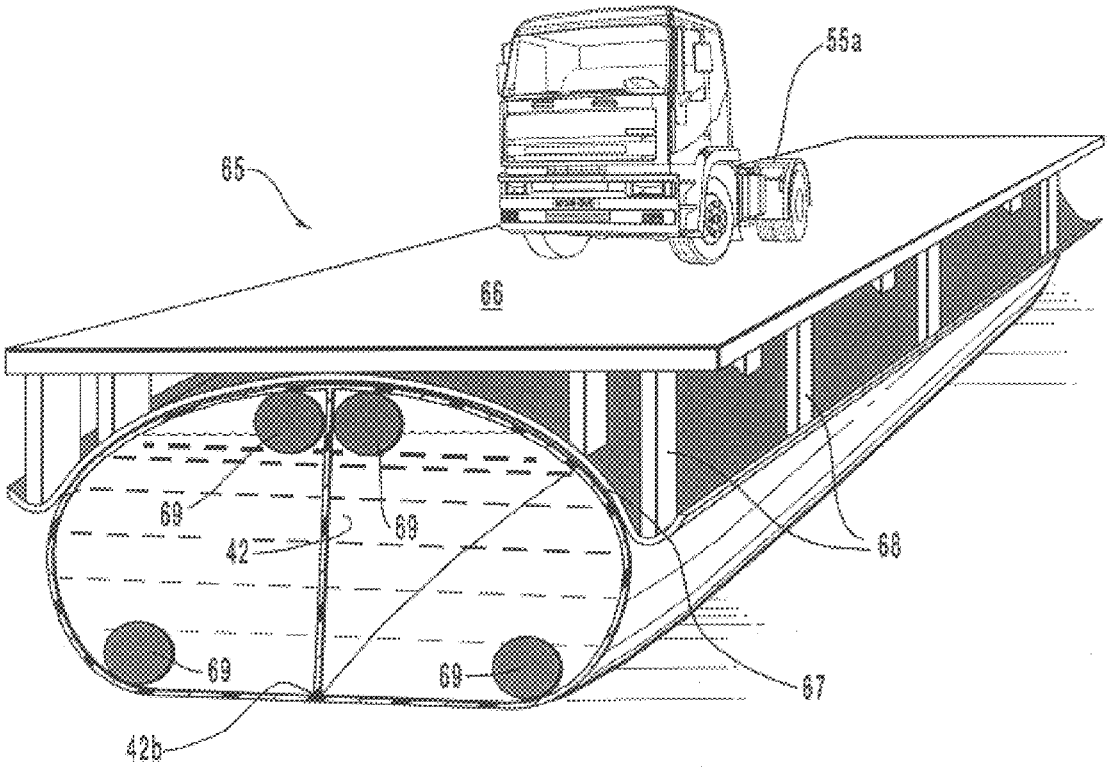
FIG. 10B is also a view like that of FIG. 9 only showing the rigid shell onto the tube or sleeve top surface of FIG. 10B and including a flat deck mounted thereon and showing the tube or sleeve as including filled buoyancy tubes fitted through the tube or sleeve sections.

FIG. 10B shows a water structure 65 that is like the water structure 60 shown in FIG. 10A to include the cap 61 with upturned edges 62 that is secured to a top surface of tube or sleeve 41 and additional includes a flat deck 66, that is formed from a rigid material and is supported on spaced inner and outer posts 67 and 68, respectively, that are shown secured at their ends to the cap 61 top surface and along the cap edges 62, respectively. So arranged, the respective post 67 and 68 tops are secured at right angles to the flat deck 66 undersurface with the deck maintained essentially parallel to the surface whereon the tube or sleeve 61 rests, to support a vehicle, shown as a truck 55*a*, or the like, thereon.

Additionally, the water structure 65 is shown as included buoyancy tubes 69 that are secured within the tube or sleeve 41, to extend longitudinally therein and are spaced apart from one another. The buoyancy tubes 69 can be filled with any buoyant material such as air, Styrofoam, or the like within the scope of this disclosure and are preferably arranged in the compartments or water body sections as are formed by divider wall 42 to be equidistant from the divider wall to provide an equal or balanced buoyancy across the tube or sleeve 41.

Where the water structure 40 of FIGS. 9 and 10, and water structures 65 and 70 of FIGS. 10A and 10A, are shown for use for supporting human and vehicle traffic as a dock, bridge, or the like, it should be understood that, to safely perform such functions, the single sleeve will preferably be formed from a tough and durable material or be capped, as shown. Accordingly, a material for single sleeve 41 will preferably be selected to have appropriate strength with wear resistance characteristics and may, as required, be reinforced as by bonding two or more sleeves together, applying a reinforcing mesh or weave of material to the sleeve surface, which material that can be cloth, metal or the like, or like reinforcing arrangement attached as by adhesive bonding can be so employed, within the scope of this disclosure.

Figure 11:
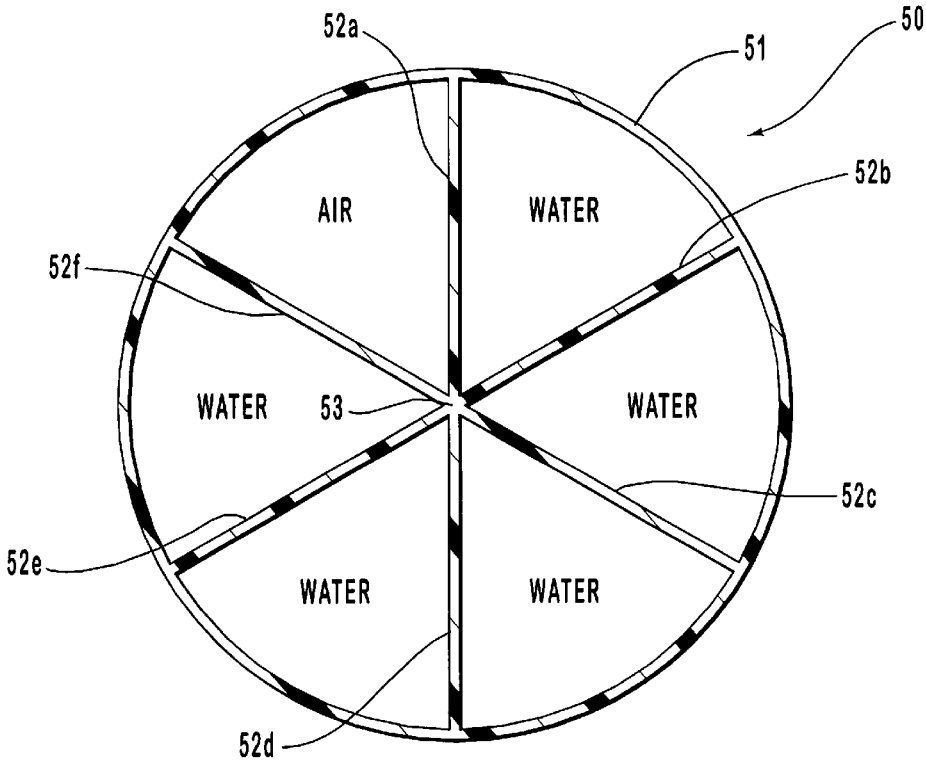
FIG. 11 is an end elevation view of a cross section of a single tube or sleeve of a water structure that includes a plurality of walls projecting radially outwardly from the tube longitudinal center that connect to the tube or sleeve interior wall at intervals there around forming tube or sleeve segments that can be individually filled, as shown, with air, or other buoyancy material, or water, for providing a water structure having a desired configuration and buoyancy.

Another embodiment of a water structure 50 is shown in FIG. 11 as consisting of a single outer sleeve 51 that can have a round cross section, as shown by may have other shape, such as a square, so long as such sleeve 51 is appropriated for used within the scope of this disclosure. The single sleeve 51 can be reinforced as by fitting two or more sleeves together, one within the other, by securing a reinforcing material thereto, or the like, as set out immediately above, and preferably includes a plurality of divider walls 52*a*, 52*b*, 52*c*, 52*d*, 52*e* and 52*f* secured together at a sleeve longitudinal axis 53, that may but need not be the sleeve longitudinal center axis, as shown. Each divider wall is to extend radially from the longitudinal axis 53 and is bonded, along its outer edge, to the single sleeve 51 inner surface forming individual compartments or sections that are for containing, as shown, water, air, or other material as desired to provide a desired buoyancy in water to the water structure 50. Such individual compartments or sections could, of course, include inlet and drain arrangements like those set out hereinabove though, of course, a single valve for each compartment or section can be so provided that is capable of use for both filling and draining the individual compartments or sections, or the sleeve can be opened at its end or ends to drain water therefrom, within the scope of this disclosure. Like the water structures 40 set out and described hereinabove with respect to FIGS. 8 through 10, and water structures 65 and 70 of FIGS. 10A and 10B, and the water structure 50 can be configured to be supported in water for use as a dock, breakwater, bridge, cause way, or the like, and when filled with water can perform the water retaining functions set out and described hereinabove with respect to the water structures 10, 20 and 30 of FIGS. 1 through 7.

Although preferred embodiments of the invention have been shown and described herein, it should be understood that the present disclosure is made by way of example only and that variations are possible within the scope of this disclosure without departing from the subject matter coming within the scope of the following claims and reasonable equivalency thereof, which claims I regard as my invention.

I claim:

1. A water structure comprising, a pair of flexible tubes or sleeves arranged to be closed at their ends forming liquid containing vessels; one or more filling means for arrangement with for filling each of said pair of flexible tubes or sleeves with water; a containing sleeve wherein said pair of flexible tubes or sleeves are maintained; and a straight tube is fitted between and separated from each of said pair of flexible tubes or sleeves to pass vertically through said containing sleeve and to project at essentially right angles outwardly from opposite points around an outer surface of said containing sleeve.

2. The water structure as recited in claim 1, wherein the pair of flexible tubes or sleeves are maintained together along shared or common surfaces, and the straight tube is fitted between said shared or common surfaces, so as not to disrupt the integrity of either of said flexible tubes or sleeves, and extends at the essentially right angles vertically outwardly from top and bottom outer surface of said containing sleeve.

3. The water structure as recited in claim 1, wherein the straight tube is an open tube that passes between said pair of flexible tubes or sleeves.

* * * * *